US012286755B2

(12) United States Patent
Wakabayashi

(10) Patent No.: US 12,286,755 B2
(45) Date of Patent: Apr. 29, 2025

(54) BINDER AND FORMED BODY PRODUCING METHOD

(71) Applicant: SEIKO EPSON CORPORATION, Tokyo (JP)

(72) Inventor: Shigemi Wakabayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 216 days.

(21) Appl. No.: 17/875,492

(22) Filed: Jul. 28, 2022

(65) Prior Publication Data

US 2023/0047851 A1 Feb. 16, 2023

(30) Foreign Application Priority Data

Jul. 30, 2021 (JP) ..... 2021-125034

(51) Int. Cl.
*D21H 17/28* (2006.01)
*D21H 11/14* (2006.01)
*D21H 17/68* (2006.01)

(52) U.S. Cl.
CPC ..... *D21H 17/28* (2013.01); *D21H 11/14* (2013.01); *D21H 17/68* (2013.01)

(58) Field of Classification Search
CPC ..... D21H 17/28; D21H 11/14; D21H 17/68; D21H 17/70; D21H 21/18; D21H 21/52; D21H 17/675; D21F 9/00; D21F 11/00; D21J 3/00
See application file for complete search history.

(56) References Cited

U.S. PATENT DOCUMENTS 6,987,076 B1 * 1/2006 Jubb ..... C09K 21/02 501/36
2020/0031090 A1 * 1/2020 Kurata ..... D21H 17/71
2020/0080262 A1 * 3/2020 Sago ..... D21H 21/06

FOREIGN PATENT DOCUMENTS

JP H05-246465 A 9/1993

* cited by examiner

*Primary Examiner* — Dennis R Cordray
*Assistant Examiner* — Matthew M Eslami
(74) *Attorney, Agent, or Firm* — Global IP Counselors, LLP

(57) ABSTRACT

A binder includes an inorganic oxide particle and a binding material particle containing a binding material to mutually bind fibers when water is provided, wherein the binder includes a composite particle in which the binding material particle and the inorganic oxide particle are integrated, the inorganic oxide particle contains carbon, and the content of the carbon is 2% by mass or more relative to the mass of the inorganic oxide particle.

1 Claim, 2 Drawing Sheets

BINDER AND FORMED BODY PRODUCING METHOD

The present application is based on, and claims priority from JP Application Serial Number 2021-125034, filed Jul. 30, 2021, the disclosure of which is hereby incorporated by reference herein in its entirety.

BACKGROUND

1. Technical Field

The present disclosure relates to a binder and a formed body producing method.

2. Related Art

A formed body producing method in which a formed body is produced by adding atomized water to a cotton-like material produced by defibrating waste paper and by further adding a powdery or granular sizing agent is proposed (refer to, for example, JP-A-5-246465) as a method for producing a formed body such as a cushioning material by recycling waste paper without using a large amount of water in contrast to a sheet forming method. Since such a formed body producing method can produce a formed body by using a small amount of water compared with the sheet forming method, there is an advantage in saving energy and time spent on dehydration, drying, and the like.

However, in the above-described formed body producing method, it is difficult to uniformly distribute a sizing agent in the formed body by just mixing the powdery sizing agent with the fiber, and it may be difficult to sufficiently ensure strength of the resulting formed body. In particular, when a sheet-like formed body such as recycled paper is produced as a formed body, if a region having a small amount of sizing agent is present, there is a problem that the formed body may be damaged due to the region serving as a starting point of damage, and the strength of the sheet may deteriorate.

SUMMARY

A binder includes an inorganic oxide particle and a binding material particle containing a binding material to mutually bind fibers when water is provided, and the binder includes a composite particle in which the binding material particle and the inorganic oxide particle are integrated, the inorganic oxide particle contains carbon, and the content of the carbon is 2% by mass or more relative to the mass of the inorganic oxide particle.

A formed body producing method includes an accumulating step of accumulating a mixture including fiber and the above-described binder, a humidifying step of providing the accumulated mixture with water, and a forming step of obtaining a formed body by heating and applying pressure to the mixture provided with water.

DESCRIPTION OF EXEMPLARY EMBODIMENTS

1. Binder

Figure 1:
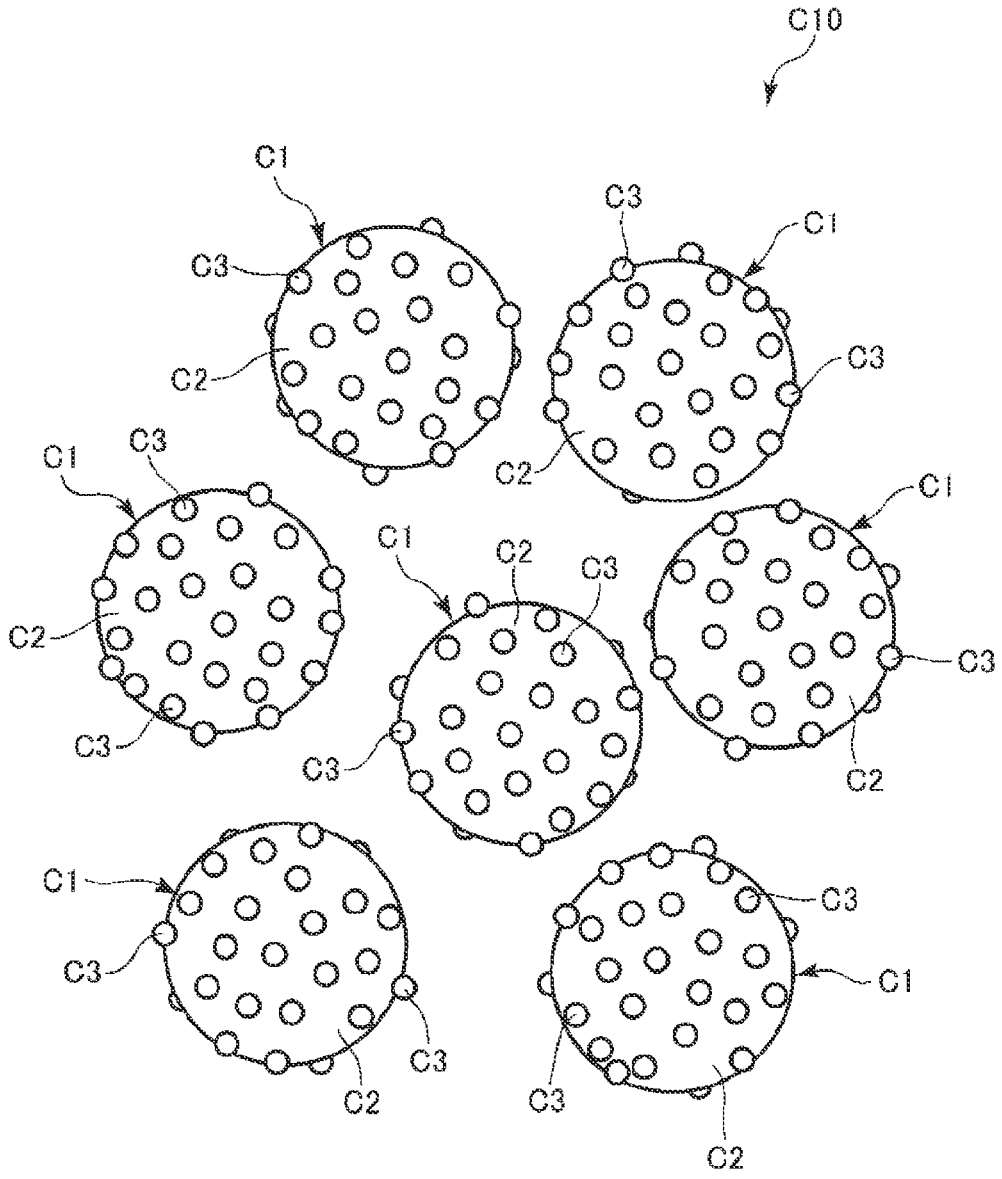
FIG. 1 is a schematic diagram of a binder according to an embodiment.

As illustrated in FIG. 1, a binder C10 includes an inorganic oxide particle C3 and a binding material particle C2 containing a binding material to mutually bind fibers when water is provided, and the binder C10 includes a composite particle C1 in which the binding material particle C2 and the inorganic oxide particle C3 are integrated, the inorganic oxide particle C3 contains carbon, and the content of the carbon is 2% by mass or more relative to the mass of the inorganic oxide particle C3.

Consequently, the formed body produced by mutually binding the fibers by using the binder C10 enables the formed body having sufficient strength to be obtained. In particular, the inorganic oxide particle C3 included in the composite particle C1 containing 2% by mass or more of carbon relative to the mass of the inorganic oxide particle C3 efficiently reduces the surface free energy of the inorganic oxide particle C3. As a result, the binder C10 can be made to more favorably conform to the fiber surface. Consequently, regarding the finally obtained formed body, the adhesiveness between the fiber and the binder C10 becomes more excellent, and the formed body is able to have excellent strength. Further, since the binder C10 according to the present disclosure has excellent dispersibility, particles of the binder C10 can be effectively suppressed from undesirably mutually flocculating during, for example, storage of the binder C10 or transportation of the binder C10 in the production process of the formed body.

In this regard, in the present disclosure, a state in which at least a portion of the inorganic oxide particle C3 attaches to the surface of the binding material particle C2 or at least a portion of the inorganic oxide particle C3 is included inside the binding material particle C2 so as to form a composite particle C1 is denoted as "a composite particle C1 in which the binding material particle C2 and the inorganic oxide particle C3 are integrated". That is, a binding material particle C2 or an inorganic oxide particle C3 not forming a composite particle C1 being included in the binder C10 is not excluded.

In the configuration illustrated in FIG. 1, regarding the composite particle C1 included in the binder C10, the inorganic oxide particle C3 is attached to the surface of the binding material particle C2.

Consequently, a repulsive force is exerted between inorganic oxide particles C3, and flocculation of binding material particles C2 does not readily occur. In this regard, the arrangement of inorganic oxide particles C3 can be examined using, for example, various electron microscopes.

1.1. Composite Particle

The composite particle C1 included in the binder C10 may be a particle in which a single inorganic oxide particle C3 is attached to the surface of a single binding material particle C2, but the binder C10, as the composite particle C1, favorably includes a particle in which a plurality of inorganic oxide particles C3 are attached to the surface of a single binding material particle C2.

Consequently, a repulsive force is effectively exerted between inorganic oxide particles C3, and flocculation of binding material particles C2 does not readily occur.

The average particle diameter of the composite particle C1 is preferably 1.0 μm or more and 100.0 μm or less, more preferably 2.0 μm or more and 70.0 μm or less, and further preferably 3.0 μm or more and 50.0 μm or less. Consequently, the composite particle C1 is readily uniformly distributed in a formed body.

In this regard, in the present specification, the average particle diameter denotes a median diameter, unless otherwise specified, the median diameter being a D50 value at a cumulative amount of frequencies of 50%. The average particle diameter can be determined based on measurement by using, for example, a Microtrac UPA produced by NIKKISO CO., LTD.

1.1.1. Binding Material Particle

The binding material particle C2 includes a binding material that mutually binds fibers when water is provided.

Examples of the binding material constituting the binding material particle C2 include components derived from natural products, such as starch, dextrin, glycogen, amylose, hyaluronic acid, vine, konnyaku, dogtooth violet starch, etherified starch, esterified starch, natural gum paste (etherified tamarind gum, etherified locust bean gum, etherified guar gum, and acacia gum Arabic), fiber-derived paste (etherified carboxymethyl cellulose and hydroxyethyl cellulose), seaweed (sodium alginate and agar-agar), and animal protein (collagen, gelatin, hydrolyzed collagen, and sericin), polyvinyl alcohols, polyacrylic acids, and polyacrylamides. One type selected from these may be used, or at least two types may be used in combination. Components derived from natural products are favorable, and starch is more favorable.

Using components derived from natural products as the binding material suppresses the need to use petroleum-derived materials and reduces the amount of $CO_2$ emitted. In addition, the materials derived from natural products have excellent biodegradability.

In particular, starch is a material which favorably exerts a binding force in response to gelatinization by heating after water is provided, that is, a binding material which favorably exerts a binding force to mutually bind fibers when water is provided. In addition, since the starch exerts a binding force with a noncovalent bond such as a hydrogen bond with respect to a fiber, in particular, a fiber such as a cellulose fiber composed of a material having a functional group, such as a hydroxy group, the starch exhibits an excellent binding force and excellent covering performance with respect to the fiber and enables the strength and the like of the formed body produced by using the binder C10 to become more excellent.

The binding material favorably contains starch having a weight average molecular weight of 50,000 or more and 400,000 or less, and the weight average molecular weight of the starch is more preferably 70,000 or more and 300,000 or less and further preferably 80,000 or more and 200,000 or less.

Consequently, the water absorption efficiency of the binder C10 can be made more excellent, and a formed body having further sufficient strength can be produced. More specifically, even when the amount of water provided is small, gelatinization of the starch by heating favorably proceeds, and the productivity of the formed body by using the binder C10 can be made excellent. In addition, the strength of the produced formed body can be made excellent. Further, regarding the starch having a weight average molecular weight value in the above-described range, undesirable denaturing due to water being provided does not readily occur.

In this regard, the weight average molecular weight of the starch can be determined based on measurement by gel permeation chromatography. The weight average molecular weights described in examples later are also values determined based on measurement by gel permeation chromatography.

The starch having a weight average molecular weight value set to be within a predetermined range can be favorably obtained as described below. The starch having a weight average molecular weight value set to be within a predetermined range can be obtained by, for example, suspending natural starch in water and causing sulfuric acid, hydrochloric acid, or sodium hypochlorite to act on the suspension under a condition in which the starch is not gelatinized. Alternatively, the starch having a weight average molecular weight value set to be within a predetermined range can be obtained by, for example, heating natural starch to 120° C. to 180° C. directly or after being mixed with a small amount of volatile acid, such as hydrochloric acid, diluted with water, sufficiently mixed, allowed to stand, and dried at low temperature. Alternatively, the starch having a weight average molecular weight value set to be within a predetermined range can be favorably obtained by, for example, subjecting a paste liquid that is the natural starch heated with water to hydrolysis treatment with an acid or an enzyme.

Starch is a polymer material in which a plurality of α-glucose molecules are polymerized by glucoside bonds. Starch contains at least one of amylose and amylopectin.

The binding material particle C2 may contain, in addition to the binding material, components other than the binding material, that is, components which do not exert a binding force to mutually bind fibers even when water is provided. Examples of such components include fiber materials and coloring materials such as pigments, dyes, and toners.

The content of the binding material in the binding material particle C2 is preferably 80% by mass or more, more preferably 90% by mass or more, and further preferably 95% by mass or more.

The average particle diameter of the binding material particle C2 is preferably 1.0 μm or more and 50.0 μm or less, more preferably 3.0 μm or more and 30.0 μm or less, and further preferably 5.0 μm or more and 15.0 μm or less.

Consequently, when a formed body is produced by binding the fiber with the binder C10, in the step of mixing the fiber and the binder C10, the fiber and the binder C10 can be more uniformly mixed. In addition, when the mixture of the fiber and the binder C10 is provided with water, absorption of water proceeds more smoothly, and the strength and the reliability of the finally obtained formed body can be made more excellent. In particular, when the particle diameter of the binding material particle C2 is relatively small as described above, the surface area per unit mass of the binding material particle C2 increases, and the water absorption efficiency of the binding material becomes more excellent. As a result, even when the amount of water provided is small, a formed body having sufficient strength can be produced.

In this regard, when the binding material particle C2 having a small average particle diameter is present without presence of the inorganic oxide particle C3 in the binder C10, flocculation of the binding material particle C2 readily occurs. However, in the present disclosure, using the composite particle C1 in which the binding material particle C2 and the inorganic oxide particle C3 are integrated enables the binding material particle C2 to be effectively prevented from flocculating. That is, even when the binding material particle C2 tends to flocculate due to the average particle diameter value of the binding material particle C2 being within the above-described range, the binding material particle C2 and the inorganic oxide particle C3 being integrated in the composite particle C1 enables the binding material particles C2 to be suppressed from mutually flocculating.

A binding material particle C2 to which an inorganic oxide particle C3 is not attached, in other words, a binding material particle C2 not constituting a composite particle C1, may be contained in the binder C10. However, the proportion of the binding material particle C2 constituting the composite particle C1 in the total binding material particle C2 contained in the binder C10 is preferably 50% by mass or more, more preferably 60% by mass or more, and further preferably 70% by mass or more.

Consequently, the binding material particles C2 can be more effectively suppressed from mutually flocculating, and a formed body having excellent strength can be produced.

1.1.2. Inorganic Oxide Particle

The binder C10 includes the inorganic oxide particle C3. In addition, the binder C10 includes the composite particle C1 in which the inorganic oxide particle C3 and the binding material particle C2 are integrated. Consequently, when the formed body is produced by mutually binding the fibers with the binder C10, since the composite particle C1 is suppressed from flocculating and since a high dispersion state can be maintained, the particle surface of the composite particle C1 serving as a charge portion can be increased. In this regard, the composite particle C1 including the inorganic oxide particle C3 enables the surface of the composite particle C1 to be maintained in a dry state so as to suppress the charge from being lost due to water. As a result, the binder C10 can be efficiently charged, the adhesive force of the binder C10 with respect to the fiber is increased, the mutual binding force of the fiber is also increased, and the formed body having excellent strength can be produced.

The inorganic oxide particle C3 is composed mainly of an inorganic oxide. Examples of the material constituting the inorganic oxide include metal oxides, such as silica, alumina, zirconia, titania, and magnetite. Of these, silica, alumina, and titania are favorable, and silica is more favorable from the viewpoint of excellent chemical and thermal stability.

The inorganic oxide particle C3 being composed mainly of silica further improves the dispersibility of the composite particle C1. As a result, the binder C10 can be effectively suppressed from undesirably flocculating during, for example, storage of the binder C10 or transportation of the binder C10 in the production process of the formed body. In this regard, since silica has a relatively low specific gravity among the inorganic oxides, the fluidity of the composite particle C1 is improved. In addition, silica is a material which does not readily affect the tint of the formed body produced by using the binder C10. In particular, when the formed body is paper, this effect is significantly exerted.

The inorganic oxide particle C3 contains carbon in addition to the inorganic oxide. Consequently, the surface free energy of the inorganic oxide particle C3 is effectively reduced. As a result, when the binder C10 is used for producing the formed body, the binder C10 can be made to favorably conform to the fiber surface. Consequently, the binder C10 is able to be uniformly distributed throughout the formed body, and the formed body is able to have more excellent strength.

The carbon contained in the inorganic oxide particle C3 is favorably carbon derived from a hydrocarbon group. More specifically, the inorganic oxide particle C3 is favorably a hydrophobic inorganic oxide particle C3 in which a base particle composed of an inorganic oxide is treated using a surface treatment agent having a hydrocarbon group. That is, carbon contained in the inorganic oxide particle C3 is favorably derived from the hydrocarbon group provided for the surface of the inorganic oxide by the surface treatment. The inorganic oxide particle C3 being such a hydrophobic inorganic oxide particle C3 enables the surface free energy of the inorganic oxide particle C3 to be more effectively reduced. As a result, when the formed body is produced by mutually binding the fibers by using the binder C10, the binder C10 can be made to more favorably conform to the fiber surface. Consequently, the binder C10 is able to be uniformly distributed throughout the formed body, and the formed body is able to have more excellent strength.

There is no particular limitation regarding the surface treatment agent to be used provided that the surface treatment agent has a hydrocarbon group, and examples include fluorine-containing compounds and silicon-containing compounds. Use of such a surface treatment agent enables carbon to be efficiently introduced into the base particle and enables the surface free energy of the inorganic oxide particle C3 to be more efficiently reduced. Consequently, the fluidity and the handleability of the binder C10 are improved. Further, the binder C10 is able to be more uniformly distributed in the finally obtained formed body, and the formed body is able to have more excellent strength.

Examples of the fluorine-containing compounds include perfluoropolyether and fluorine-modified silicone oil.

Examples of the silicon compound include silane coupling agents, titanate-based coupling agents, silicone oils, cyclic siloxanes, hexaalkyldisilazanes, and alkyldichlorosilanes. Of these, hexaalkyldisilazanes and alkyldichlorosilanes are favorably used for treatment because of a high treatment effect and a low possibility of elution or bleeding of the surface treatment agent. Since the above-described treatment agent has high reactivity, even when the amount of the reactive group such as a silanol group present on the surface of the inorganic oxide particle C3 is small, a necessary amount of carbon can be introduced into the inorganic oxide particle C3 with a favorable treatment efficiency.

When the surface treatment agent is used, one surface treatment agent may be used, or a plurality of types of surface treatment agents may be used.

When a plurality of surface treatment agents are used, a plurality of types of surface treatment agents may be used with respect to a single base particle, or the binder C10 may include particles, serving as the inorganic oxide particles C3, treated using respective surface treatment agents that differ from each other.

The content of the surface treatment agent relative to 100 parts by mass of the base particle included in the binder C10 is preferably 0.5 parts by mass or more and 7.0 parts by mass or less and more preferably 1.0 part by mass or more and 5.0 parts by mass or less.

The base particle composed of the inorganic compound being subjected to the treatment by using the surface treatment agent having a hydrocarbon group introduces carbon into the base particle with a chemical bond interposed therebetween and enables the inorganic oxide particle C3 containing 2% by mass or more of carbon to be obtained.

In this regard, the inorganic oxide particle C3 contains 2% by mass or more of carbon relative to the mass of the inorganic oxide particle C3. The inorganic oxide particle C3 contains preferably 2.5% by mass or more of carbon relative to the mass of the inorganic oxide particle C3 and contains more preferably 3.0% by mass or more of carbon. In addition, the inorganic oxide particle C3 contains preferably 7.0% by mass or less of carbon relative to the mass of the inorganic oxide particle C3 and contains more preferably 5.0% by mass or less of carbon. In this regard, the amount of carbon contained in the inorganic oxide particle C3 can be quantified from the decrement of the mass when the inorganic oxide particle is burned.

The average particle diameter of the inorganic oxide particle C3 is preferably 1.0 nm or more and 20.0 nm or less, more preferably 3.0 nm or more and 18.0 nm or less, and further preferably 5.0 nm or more and 10.0 nm or less.

Consequently, excessive unevenness of the surface of the composite particle C1 in which the inorganic oxide particle C3 is attached to the surface of the binding material particle C2 is favorably suppressed from occurring. As a result, when the composite particle C1 is mixed with the fiber, the fluidity of the binder C10 can be made more excellent, and the composite particle C1 can be more uniformly mixed with the fiber. In addition, the inorganic oxide particle C3 can be more favorably attached to the surface of the binding material particle C2, and the inorganic oxide particle C3 can be prevented from undesirably detaching from the surface of the binding material particle C2 or from undesirably being buried inside the binding material particle C2.

Further, since the average particle diameter of the inorganic oxide particle C3 is 1.0 nm or more and 20.0 nm or less, an effect obtained by the binding material particle C2 and the inorganic oxide particle C3 being integrated is more considerably exerted; that is, a repulsive force is exerted between inorganic oxide particles C3, the binding material particles C2 are suppressed from mutually flocculating, and the dispersibility of the composite particle C1 is improved.

An inorganic oxide particle C3 which is not attached to a binding material particle C2, in other words, an inorganic oxide particle C3 not constituting a composite particle C1, may be contained in the binder C10. However, the proportion of the inorganic oxide particle C3 constituting the composite particle C1 in the inorganic oxide particle C3 contained in the binder C10 is preferably 50% by mass or more, more preferably 60% by mass or more, and further preferably 70% by mass or more. Consequently, the binding material particles C2 are suppressed from mutually flocculating, and the dispersibility of the composite particle C1 is improved.

Commercially available products can also be used as the inorganic oxide particle C3. Examples of commercially available products of the inorganic oxide particle C3 include fumed silica, trade name: REOLOSIL (registered trademark) DM-30S, KS-20SC, HM-20L, HM-30S, and ZD-30ST, produced by Tokuyama Corporation, and fumed silica, trade name: AEROSIL (registered trademark) RY-50, RY-51, NY-50, NY-50L, RA200H, and RA200HS, produced by NIPPON AEROSIL CO., LTD.

In the binder C10, the mass of the inorganic oxide particle C3 relative to the mass of the binding material particle C2 is preferably 0.3% by mass or more and 8.0% by mass or less, more preferably 0.5% by mass or more and 5.0% by mass or less, and further preferably 0.7% by mass or more and 4.0% by mass or less.

Consequently, the dispersion stability of the composite particle C1 is improved. That is, the mass of the inorganic oxide particle C3 relative to the binding material particle C2 being set to be within the above-described range suppresses the composite particles C1 from mutually flocculating so as to form a coarse particle and cause the composite particle C1 to have more excellent dispersion stability.

1.1.3. Other Configuration

The binder C10 includes the above-described composite particle C1 and may further include other configurations. For example, the binder C10 may include a binding material particle C2 to which an inorganic oxide particle C3 is not attached in addition to the above-described composite particle C1 or may include an inorganic oxide particle C3 which is not attached to the binding material particle C2.

However, the content of the composite particle C1 in the binder C10 is preferably 50% by mass or more, more preferably 70% by mass or more, and further preferably 80% by mass or more. Consequently, the above-described effect is more considerably exerted.

1.1.4. Other Conditions

It is preferable that the binder C10 satisfy the following condition.

For example, the content of the binding material particle C2 in the binder C10 is preferably 90.0% by mass or more and 99.9% by mass or less, more preferably 95.0% by mass or more and 99.7% by mass or less, and further preferably 97.0% by mass or more and 99.4% by mass or less.

Consequently, the above-described effect is more considerably exerted.

In this regard, the content of the inorganic oxide particle C3 in the binder C10 is preferably 0.1% by mass or more and 10.0% by mass or less, more preferably 0.3% by mass or more and 5.0% by mass or less, and further preferably 0.6% by mass or more and 3.0% by mass or less.

Consequently, an effect obtained by the binding material particle C2 and the inorganic oxide particle C3 being integrated is more considerably exerted; that is, a repulsive force is exerted between inorganic oxide particles C3, the binding material particles C2 are suppressed from mutually flocculating, and the dispersibility of the composite particle C1 is improved.

2. Binder Producing Method

The binder C10 can be produced by mixing the binding material particle C2 and the inorganic oxide particle C3 by using a method known to a person skilled in the art.

When a starch particle is used as the binding material particle C2, the weight average molecular weight of the starch is adjusted by using the above-described method, the average particle diameter of the starch particle is adjusted by performing classification by using a known method, and the starch particle can be used for producing the binder C10. Regarding the inorganic oxide particle C3, materials for forming the inorganic oxide particle C3 are prepared, and carbon is introduced by using a surface treatment agent containing a hydrocarbon. Regarding the method for introducing carbon into the inorganic oxide particle C3, a known method for introducing a hydrophobic substance into the surface can be used without limitation.

The thus prepared inorganic oxide particle C3 into which a predetermined amount of carbon is introduced and the binding material particle C2 are mixed and agitated by using an agitator, such as a Super mixer, a Henschel mixer, or a Turbulizer. When the binding material particle C2 and the inorganic oxide particle C3 are agitated under a predetermined shear force, frictional heat is generated on the particle surface, and integration of the binding material particle C2 and the inorganic oxide particle C3 proceeds. After the mixing, the binder C10 can be obtained by performing sifting treatment by using a sieve having openings of 20 μm to 100 μm.

3. Formed Body Producing Method

A formed body producing method in which the formed body is produced by mutually binding the fibers by using the binder C10 will be described below. The formed body producing method includes an accumulating step of accumulating a mixture including fiber and the binder C10, a humidifying step of providing the accumulated mixture with water, and a forming step of obtaining a formed body by heating and applying pressure to the mixture provided with water.

3.1. Accumulating Step

In the accumulating step, a mixture including the fiber and the binder C10 is accumulated in air.

There is no particular limitation regarding the mixing ratio of the binder C10 to the fiber in the present step, and the content of the binder C10 in the mixture obtained by the present step is preferably 1% by mass or more and 50% by mass or less, more preferably 2% by mass or more and 45% by mass or less, and further preferably 3% by mass or more and 40% by mass or less.

Consequently, the content of the fiber in the finally obtained formed body can be made sufficiently high, and the formed body can have more excellent strength. In addition, the binder C10 can be more smoothly transported in the production process of the formed body.

In the present step, the fiber mixed with the binder C10 may be subjected to humidifying treatment prior to, for example, the humidifying step, that is, the step of performing humidifying treatment of the mixture, described later. In this regard, the fiber may be humidified between mixing with the binder C10 and accumulation of the mixture obtained by the mixing.

In the above-described instance, the water content in the fiber subjected to the present step is preferably 0.1% by mass or more and 12.0% by mass or less, more preferably 0.2% by mass or more and 10.0% by mass or less, and further preferably 0.3% by mass or more and 9.0% by mass or less.

Consequently, for example, the fiber can be prevented from being affected by static electricity before the present step. For example, the fiber can be effectively prevented from being attached to the wall surface and the like of a formed body producing apparatus due to static electricity, and the fiber and the binder C10 can be more uniformly mixed.

The fiber is a main component of a formed body produced by using the formed body producing method and is a component that largely contributes to shape retention of the formed body and that has a large influence on the characteristics such as strength of the formed body.

The fiber may be composed of any material, and it is preferable that the material maintain a fiber state regardless of heating in the forming step.

The fiber may be a synthetic fiber composed of a synthetic resin, such as a polypropylene, a polyester, or a polyurethane, and the fiber is more favorably a fiber derived from a natural material, in particular a cellulose fiber.

Cellulose fiber is reusable fiber. Reuse of cellulose fiber which has been used at least once, such as waste paper and waste cloth, as raw materials for forming fiber leads to preservation of forest resources. In addition, of various types of fibers, cellulose fiber has particularly high theoretical strength and provides an advantage of further improving the strength of the formed body.

Cellulose fiber is usually composed mainly of cellulose and may contain components other than cellulose. Examples of such a component include hemicellulose and lignin.

In particular, it is preferable that the fiber be composed of a substance having a chemical structure of at least one of a hydroxy group, a carbonyl group, and an amino group.

Consequently, for example, when starch is used as the binding material, formation of a hydrogen bond between the fiber and the binding material is facilitated, binding strength between the fiber and the binder C10 can be made more excellent, and the strength of the entire formed body, for example, breaking strength and the like of a sheet-like formed body, can be made more excellent.

In this regard, the cellulose fiber subjected to breaching treatment and the like may be used.

In addition, the fiber may be subjected to treatment such as ultraviolet irradiation treatment, ozone treatment, or plasma treatment. Consequently, the hydrophilicity of the fiber can be enhanced, and the affinity for the binding material can be enhanced. More specifically, a functional group such as a hydroxy group can be introduced on the surface of the fiber by such treatments, and a hydrogen bond can be more efficiently formed between the fiber and the binding material.

There is no particular limitation regarding the average length of the fiber, and the average length is preferably 0.1 mm or more and 50.0 mm or less, more preferably 0.2 mm or more and 5.0 mm or less, and further preferably 0.3 mm or more and 3.0 mm or less.

Consequently, the resulting formed body can have more excellent shape stability, strength, and the like.

There is no particular limitation regarding the average thickness of the fiber, and the average thickness is preferably 0.005 mm or more and 0.500 mm or less and more preferably 0.010 mm or more and 0.050 mm or less.

Consequently, the resulting formed body can have more excellent shape stability, strength, and the like. In addition, unevenness of the surface of the formed body can be effectively prevented from undesirably occurring.

There is no particular limitation regarding the average aspect ratio, that is, the ratio of the average length to the average thickness, of the fiber, and the average aspect ratio is preferably 10 or more and 1,000 or less and more preferably 15 or more and 500 or less.

Consequently, the resulting formed body can have more excellent shape stability, strength, and the like. In addition, unevenness of the surface of the resulting formed body can be effectively prevented from undesirably occurring.

3.2. Humidifying Step

In the humidifying step, the mixture accumulated in the accumulating step, that is, the mixture including the fiber and the binder C10, is humidified by when water is provided.

Consequently, in the forming step described later, the binding strength between the fiber and the binding material and the mutual binding strength of the fiber with the binding material interposed therebetween can be made excellent, and the strength and the like of the finally obtained formed body can be made sufficiently excellent. In addition, forming in the forming step can be favorably performed under a relatively moderate condition.

There is no particular limitation regarding the method for humidifying the mixture, and it is preferable that humidifying be performed on the mixture in a noncontact manner. Examples of the method include a method in which the mixture is placed in a high humidity atmosphere, a method in which the mixture is passed through a high humidity space, a method in which mist of a liquid containing water is blown onto the mixture, and a method in which the mixture is passed through a space including suspended mist of a liquid containing water. A method selected from these may be used, or at least two methods may be used in combination. More specifically, the mixture may be humidified by using various humidifiers and the like of, for example, a vaporizing type or an ultrasonic type. The mixture may be humidified in a plurality of stages in, for example, the formed body producing process. In this regard, for example, a preservative, a fungicide, and an insecticide may be contained in the liquid containing water.

There is no particular limitation regarding the amount of water provided for the mixture in the humidifying step, and the amount of water provided for 100 parts by mass of the mixture subjected to the humidifying step is preferably 1 part by mass or more and 50 parts by mass or less, more preferably 5 parts by mass or more and 40 parts by mass or less, and further preferably 10 parts by mass or more and 30 parts by mass or less.

Consequently, a formed body having sufficient strength can be produced by using a considerably small amount of water compared with the sheet forming method in the related art, and the effect of the present disclosure can be considerably exerted.

3.3. Forming Step

In the forming step, the mixture humidified in the humidifying step is subjected to pressure and heated. Consequently, a formed body is obtained. In this regard, the humidifying step and the forming step may be simultaneously performed.

There is no particular limitation regarding the pressure applied to the mixture during the forming step, and the pressure is preferably 0.1 MPa or more and 100.0 MPa or less and more preferably 0.3 MPa or more and 80.0 MPa or less.

Consequently, the binder C10 can be made to more favorably conform to the fiber surface. As a result, the strength of the resulting formed body can be made more excellent.

There is no particular limitation regarding the heating temperature in the forming step, and the heating temperature is preferably 50° C. or higher and 200° C. or lower, more preferably 60° C. or higher and 150° C. or lower, and further preferably 70° C. or higher and 120° C. or lower.

Consequently, the constituent components of the fiber and the binder C10 can be effectively prevented from, for example, undesirably deteriorating or denaturing, and the binder C10 can be made to more favorably conform to the fiber surface. As a result, the resulting formed body is able to have more excellent strength and reliability. In addition, the above is preferable from the viewpoint of energy conservation. In particular, the binding material particle C2 being composed of a material containing starch as the binding material enables gelatinization of the starch containing water to favorably proceed and enables the constituent material of the formed body to be effectively prevented from undesirably deteriorating and the like.

The forming step can be performed by using, for example, a heat press or a heat roller. Consequently, the constituent components of the fiber and the binder C10 can be effectively prevented from, for example, undesirably deteriorating or denaturing, and the binder C10 can be made to more favorably conform to the fiber surface. As a result, the resulting formed body is able to have more excellent strength and reliability.

Regarding the binder C10, the inorganic oxide particle C3 containing 2% by mass or more of carbon relative to the mass of the inorganic oxide particle C3 enables the repose angle of the binder C10 to be reduced. Consequently, in the formed body producing method, when the binder C10 is used as the binder C10 for mutually binding the fibers, the composite particle C1 can be uniformly mixed with the fiber. As a result, a formed body in which the binder C10 is uniformly distributed can be obtained, and the formed body having sufficient strength can be produced.

The formed body producing method described above can be favorably realized by using, for example, a formed body producing apparatus described below.

4. Formed Body Producing Apparatus

Next, the formed body producing apparatus will be described.

Figure 2:
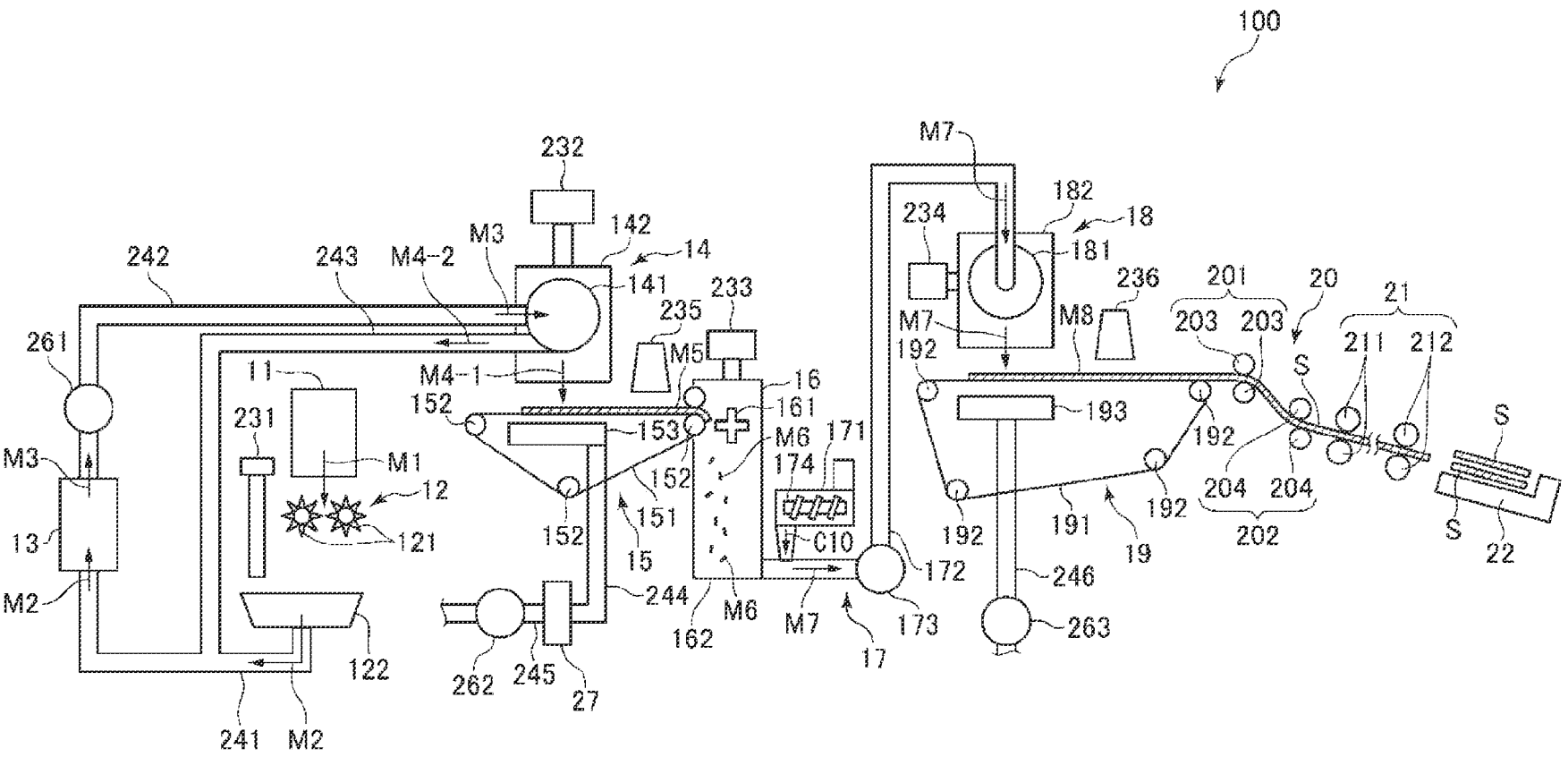
FIG. 2 is a schematic side view illustrating the configuration of a producing apparatus suitable for realizing the formed body producing method.

FIG. 2 is a schematic explanatory diagram illustrating the configuration of a producing apparatus suitable for realizing the formed body producing method. Hereafter, for the sake of facilitating explanation, the upper side of FIG. 2 is also denoted by "up" or "above", the lower side is also denoted by "down" or "below", the left side is also denoted by "left" or "upstream", and right side is also denoted by "right" or "downstream".

In the following explanation, a sheet producing apparatus 100 that produces a sheet S as a formed body will be described as an example of the formed body producing apparatus.

As illustrated in FIG. 2, the sheet producing apparatus 100 serving as a formed body producing apparatus includes a raw material supply portion 11, a coarse crushing portion 12, a defibration portion 13, a sorting portion 14, a first web forming portion 15, a subdivision portion 16, a mixing portion 17, a disentanglement portion 18, a second web forming portion 19, a sheet forming portion 20, a cutting portion 21, and a stock portion 22. In addition, the sheet producing apparatus 100 includes a humidifying portion 231, a humidifying portion 232, a humidifying portion 233, and a humidifying portion 234.

The operation of each portion included in the sheet producing apparatus 100 is controlled by a control portion not illustrated in the drawing.

The method for producing a sheet S which is a formed body includes a raw material supply step, a coarse crushing step, a defibration step, a sorting step, a first web forming step, a subdivision step, a mixing step, a disentanglement step, a second web forming step, a humidifying step, a sheet forming step, and a cutting step. In this regard, the sheet producing apparatus 100 can perform these steps successively.

The configuration of each portion included in the sheet producing apparatus 100 will be described below.

The raw material supply portion 11 is a portion for performing the raw material supply step of supplying a sheet-like material M1 to the coarse crushing portion 12. The sheet-like material M1 is a sheet-like material including a fiber such as a cellulose fiber.

The coarse crushing portion 12 is a portion for performing the coarse crushing step of coarsely crushing the sheet-like material M1 supplied from the raw material supply portion 11 in gas such as air. The coarse crushing portion 12 includes a pair of coarse crushing blades 121 and a hopper 122.

The pair of coarse crushing blades 121 rotating in directions opposite to each other enables the sheet-like material M1 to be coarsely crushed, that is, cut, between the blades so as to produce a coarsely crushed piece M2. It is preferable that the shape and the size of the coarsely crushed piece M2 be suitable for defibration treatment in the defibration portion 13. For example, the coarsely crushed piece M2 is preferably a small piece having a length of a side of 100 mm or less and is more preferably a small piece having a length of a side of 10 mm or more and 70 mm or less.

The hopper 122 is arranged below the pair of coarse crushing blades 121 and has, for example, a funnel-like shape. Consequently, the hopper 122 can receive the coarsely crushed piece M2 that is coarsely crushed by the coarse crushing blades 121 and falls.

In addition, the humidifying portion 231 adjoining the coarse crushing blades 121 is disposed above the hopper 122. The humidifying portion 231 humidifies the coarsely crushed piece M2 in the hopper 122. The humidifying portion 231 includes a filter containing water, not illustrated in the drawing, and is composed of a vaporizing-type humidifier which supplies humidified air whose humidity is increased by passing the air to the coarsely crushed piece M2 through the filter. Supplying the humidified air to the coarsely crushed piece M2 enables attachment of the coarsely crushed piece M2 to the hopper 122 and the like due to static electricity to be controlled.

The hopper 122 is coupled to the defibration portion 13 through a pipe 241 serving as a flow passage. The coarsely crushed piece M2 collected in the hopper 122 is transported to the defibration portion 13 through the pipe 241.

The defibration portion 13 is a portion for performing the defibration step of defibering the coarsely crushed piece M2 in gas such as air, that is, in a dry system. A defibered material M3 can be produced from the coarsely crushed piece M2 by the defibration treatment in the defibration portion 13. Herein, "defiber" denotes the coarsely crushed piece M2 in which a plurality of fibers are bound while being disentangled into individual fibers. The disentangled material is the defibered material M3. The shape of the defibered material M3 is linear or band-like. In this regard, the defibered materials M3 may be present in a mutually entangled cluster state, that is, in a state of forming a so-called "clump".

For example, in the present embodiment, the defibration portion 13 is composed of an impeller mill having a rotor which rotates at a high speed and a liner located at an outer circumference of the rotor. The coarsely crushed piece M2 that flows into the defibration portion 13 is defibered by being pinched in between the rotor and the liner.

In addition, the defibration portion 13 can generate a stream of air, that is, a gas stream, from the coarse crushing portion 12 toward the sorting portion 14 due to the rotation of the rotor. Consequently, the coarsely crushed piece M2 can be suctioned from the pipe 241 to the defibration portion 13. In this regard, after defibration treatment, the defibered material M3 can be sent to the sorting portion 14 through a pipe 242.

A blower 261 is disposed midstream of the pipe 242. The blower 261 is a gas stream generator for generating a gas stream toward the sorting portion 14. Consequently, sending the defibered material M3 to the sorting portion 14 is facilitated.

The sorting portion 14 is a portion for performing the sorting step of sorting the defibered material M3 in accordance with the length of the fiber. In the sorting portion 14, the defibered material M3 is sorted into a first sorted material M4-1 and a second sorted material M4-2 larger than the first sorted material M4-1. The first sorted material M4-1 has a size suitable for producing sheet S thereafter. The second sorted material M4-2 includes, for example, an insufficiently defibered material and a material formed of defibered fiber that has been excessively mutually flocculated.

The sorting portion 14 includes a drum portion 141 and a housing portion 142 for housing the drum portion 141.

The drum portion 141 is a sieve composed of a cylindrical mesh body that rotates about the center axis thereof. The defibered material M3 flows into the drum portion 141. The defibered material M3 smaller than the mesh openings is sorted as the first sorted material M4-1, and the defibered material M3 larger than the mesh openings is sorted as the second sorted material M4-2 due to the drum portion 141 rotating.

The first sorted material M4-1 falls from the drum portion 141.

The second sorted material M4-2 is sent to a pipe 243 serving as a flow passage coupled to the drum portion 141. An end of the pipe 243 opposite to the drum portion 141 is coupled to the pipe 241. The second sorted material M4-2 that has passed through the pipe 243 is merged with the coarsely crushed piece M2 in the pipe 241 and flows into the defibration portion 13 with the coarsely crushed piece M2. Consequently, the second sorted material M4-2 is returned to the defibration portion 13 and subjected to the defibration treatment with the coarsely crushed piece M2.

In this regard, the first sorted material M4-1 from the drum portion 141 is dispersed in air and falls to the first web forming portion 15 serving as a separating portion located below the drum portion 141. The first web forming portion 15 is a portion for performing the first web forming step of forming a first web M5 from the first sorted material M4-1. The first web forming portion 15 includes a mesh belt 151 serving as a separating belt, three stretching rollers 152, and a suction portion 153.

The mesh belt 151 is an endless belt on which the first sorted material M4-1 is accumulated. The mesh belt 151 is looped around the three stretching rollers 152. In this regard, the first sorted material M4-1 on the mesh belt 151 is transported downstream due to the stretching rollers 152 being driven to rotate.

The first sorted material M4-1 is larger than the openings of the mesh belt 151. Consequently, the first sorted material M4-1 is restricted from passing through the mesh belt 151, and the first sorted material M4-1 can be accumulated on the mesh belt 151. In this regard, since the first sorted material M4-1 is accumulated on the mesh belt 151 and is transported downstream by the mesh belt 151, a layered first web M5 is formed.

In addition, for example, dust and dirt may be included in the first sorted material M4-1. For example, dust and dirt may be included with the sheet-like material M1 when the sheet-like material M1 is supplied from the raw material supply portion 11 to the coarse crushing portion 12. The dust and the dirt particles are smaller than the openings of the mesh belt 151. Consequently, the dust and the dirt pass through the mesh belt 151 and fall.

The suction portion 153 can suction air from below the mesh belt 151. Consequently, the dust and the dirt which have passed through the mesh belt 151 can be suctioned with air.

The suction portion 153 is coupled to a recovery portion 27 through a pipe 244 serving as a flow passage. The dust and the dirt suctioned in the suction portion 153 are recovered into the recovery portion 27.

The recovery portion 27 is further coupled to a pipe 245 serving as a flow passage. In addition, a blower 262 is disposed midstream of the pipe 245. A suction force can be generated in the suction portion 153 due to the blower 262 being operated. Consequently, formation of the first web M5 on the mesh belt 151 is facilitated. The dust and the dirt are removed from the first web M5. In this regard, the dust and the dirt pass through the pipe 244 and reach the recovery portion 27 due to the blower 262 being operated.

The housing portion 142 is coupled to the humidifying portion 232. The humidifying portion 232 is composed of a vaporizing-type humidifier akin to that in the humidifying portion 231. Consequently, humidified air is supplied into the housing portion 142. The first sorted material M4-1 can be humidified by the humidified air, and, therefore, the first sorted material M4-1 can also be suppressed from being attached to the inner wall of the housing portion 142 due to an electrostatic force.

A humidifying portion 235 is disposed downstream of the sorting portion 14. The humidifying portion 235 is composed of an ultrasonic humidifier that sprays water. Consequently, water can be supplied to the first web M5, and the amount of water of the first web M5 can be adjusted. This water adjustment can suppress the first web M5 from adsorbing to the mesh belt 151 due to an electrostatic force. As a result, the first web M5 is readily peeled from the mesh belt 151 at the position at which the mesh belt 151 is folded back by the stretching roller 152.

The subdivision portion 16 is disposed downstream of the humidifying portion 235. The subdivision portion 16 is a portion for performing the cutting step of cutting the first web M5 peeled from the mesh belt 151. The subdivision portion 16 includes a rotatively supported propeller 161 and a housing portion 162 for housing the propeller 161. In this regard, the first web M5 being caught in the rotating propeller 161 enables the first web M5 to be cut. The resulting first web M5 serves as a subdivided body M6. The subdivided body M6 falls in the housing portion 162.

The housing portion 162 is coupled to the humidifying portion 233. The humidifying portion 233 is composed of a vaporizing-type humidifier akin to that in the humidifying portion 231. Consequently, humidified air is supplied into the housing portion 162. The humidified air can also suppress the subdivided body M6 from being attached to the propeller 161 and the inner wall of the housing portion 162 due to an electrostatic force.

The mixing portion 17 is disposed downstream of the subdivision portion 16. The mixing portion 17 is a portion for performing the mixing step of mixing the subdivided body M6 with the binder C10. The mixing portion 17 includes a binder supply portion 171, a pipe 172 serving as a flow passage, and a blower 173.

The pipe 172 couples the housing portion 162 of the subdivision portion 16 to the housing portion 182 of the disentanglement portion 18 and is a flow passage through which a mixture M7 of the subdivided body M6 and the binder C10 passes.

A binder supply portion 171 is disposed midstream of the pipe 172. The binder supply portion 171 includes a screw feeder 174. The screw feeder 174 being driven to rotate enables the binder C10 to be supplied to the pipe 172. The binder C10 supplied to the pipe 172 is mixed with the subdivided body M6 so as to form the mixture M7.

In this regard, in the binder C10 from the binder supply portion 171, for example, a coloring agent for coloring the fiber, a flocculation inhibitor for suppressing the fiber from being flocculated and suppressing the binder C10 from being flocculated, and a flame retardant for suppressing the fiber and the like from readily burning may be contained.

A blower 173 is disposed midstream of the pipe 172 and downstream of the binder supply portion 171. The blower 173 can generate a gas stream toward the disentanglement portion 18. The resulting gas stream can agitate the subdivided body M6 and the binder C10 in the pipe 172. Consequently, the mixture M7 in the state in which the subdivided body M6 and the binder C10 are uniformly dispersed can flow into the disentanglement portion 18. In this regard, the subdivided body M6 in the mixture M7 is disentangled while passing through the pipe 172 so as to take on a finer fiber state.

The disentanglement portion 18 is a portion for performing the disentanglement step of disentangling mutually entangled fibers in the mixture M7. The disentanglement portion 18 includes a drum portion 181 and a housing portion 182 for housing the drum portion 181.

The drum portion 181 is a sieve composed of a cylindrical mesh body that rotates about the center axis thereof. The mixture M7 flows into the drum portion 181. The fiber and the like, in the mixture M7, smaller than the openings of the mesh can pass through the drum portion 181 due to the drum portion 181 rotating. At this time, the mixture M7 is disentangled.

The housing portion 182 is coupled to the humidifying portion 234. The humidifying portion 234 is composed of a vaporizing-type humidifier akin to that in the humidifying portion 231. Consequently, humidified air is supplied into the housing portion 182. The humidified air can humidify the housing portion 182 interior and, thereby, can also suppress the mixture M7 from being attached to the inner wall of the housing portion 182 due to an electrostatic force.

The mixture M7 disentangled in the drum portion 181 is dispersed in air and falls to the second web forming portion 19 located below the drum portion 181. The second web forming portion 19 is a portion for performing the second web forming step of forming a second web M8 from the mixture M7. The second web forming step in the present embodiment is the accumulating step of accumulating the mixture M7 containing the fiber and the binder C10 in air. The second web forming portion 19 includes a mesh belt 191 serving as a separating belt, stretching rollers 192, and a suction portion 193.

The mesh belt 191 is an endless belt on which the mixture M7 is accumulated. The mesh belt 191 is looped over four stretching rollers 192. In this regard, the mixture M7 on the mesh belt 191 is transported downstream due to the stretching rollers 192 being driven to rotate.

In this regard, most of the mixture M7 on the mesh belt 191 is larger than the openings of the mesh belt 191. Consequently, passing of the mixture M7 through the mesh belt 191 is restricted, and the mixture M7 can be accumulated on the mesh belt 191. In addition, since the mixture M7 is accumulated on the mesh belt 191 and is transported downstream with the mesh belt 191, a layered second web M8 is formed.

The suction portion 193 can suction air from below the mesh belt 191. Consequently, the mixture M7 can be suctioned on the mesh belt 191, and accumulation of the mixture M7 on the mesh belt 191 is thereby facilitated.

A pipe 246 serving as a flow passage is coupled to the suctioning portion 193. In addition, a blower 263 is disposed midstream of the pipe 246. A suction force can be generated in the suction portion 193 due to the blower 263 being operated.

A humidifying portion 236 is disposed downstream of the disentanglement portion 18. The humidifying portion 236 is a portion for performing the humidifying step. The humidifying portion 236 is composed of an ultrasonic humidifier akin to that in the humidifying portion 235. Consequently, water can be supplied to the second web M8, and, therefore, the amount of water of the second web M8 can be adjusted. This water adjustment enables a binding force between the fiber and the binding material in a sheet S, which is a finally obtained formed body, to become favorable.

In addition, humidification enables the second web M8 to be suppressed from adsorbing to the mesh belt 191 due to an electrostatic force. Consequently, the second web M8 is readily peeled from the mesh belt 191 at the position at which the mesh belt 191 is folded back by the stretching roller 192.

The sheet forming portion 20 is disposed downstream of the second web forming portion 19. The sheet forming portion 20 is a portion for performing the sheet forming step that is the forming step of forming the sheet S from the second web M8. The sheet forming portion 20 includes a pressure-applying portion 201 and a heating portion 202.

The pressure-applying portion 201 includes a pair of calender rollers 203, and the second web M8 can be subjected to pressure between these rollers. Consequently, the density of the second web M8 is increased. Subsequently, the second web M8 is transported toward the heating portion 202. In this regard, one of the pair of calender rollers 203 is a main driving roller that is driven due to operation of a motor not illustrated in the drawing, and the other is a driven roller.

The heating portion 202 includes a pair of heating rollers 204, and the second web M8 can be heated and subjected to pressure between these rollers. In the second web M8, the binder C10 is melted due to the heating and pressure application, and the fibers are mutually bound with the molten binder C10 interposed therebetween.

Consequently, the sheet S that is a formed body is formed. Subsequently, the resulting sheet S is transported toward the cutting portion 21. In this regard, one of the pair of heating rollers 204 is a main driving roller that is driven due to operation of a motor not illustrated in the drawing, and the other is a driven roller.

The cutting portion 21 is disposed downstream of the sheet forming portion 20. The cutting portion 21 is a portion for performing the cutting step of cutting the sheet S. The cutting portion 21 includes a first cutter 211 and a second cutter 212.

The first cutter 211 cuts the sheet S in the direction intersecting the transportation direction of the sheet S.

The second cutter 212 cuts the sheet S in the transportation direction of the sheet S downstream of the first cutter 211.

The sheet S that is a formed body having a predetermined size is obtained due to such cutting performed by the first cutter 211 and the second cutter 212. Subsequently, the resulting sheet S is further transported downstream and is accumulated in the stock portion 22.

5. Examples

Next, examples according to the present disclosure will be described.

5.1 Preparation of Binder

5.1.1. Preparation of Raw Material Starch

A starch having a weight average molecular weight of 1,300,000 (G-800 produced by NIPPON STARCH CHEMICAL CO., LTD.) was suspended in water. Thereafter, sulfuric acid was made to act under a condition in which the starch was not gelatinized, sufficient mixing was performed, and agitation was performed for 12 hours. After the water content was set to be 10% by mass or less by performing drying at 50° C. for 24 hours, heating was performed at 120° C. to 180° C. so as to obtain a paste-like starch. Subsequently, the paste-like starch was washed with water, freeze-dried, and coarsely crushed so as to obtain raw material starch 1 having a weight average molecular weight of 100,000. In addition, raw material starch 2 (weight average molecular weight of 20,000), raw material starch 3 (weight average molecular weight of 55,000), raw material starch 4 (weight average molecular weight of 380,000), and raw material starch 5 (weight average molecular weight of 470,000), each having a weight average molecular weight different from that of raw material starch 1, were obtained by the treatment akin to that in the production of raw material starch 1 except that the treatment conditions (sulfuric acid concentration and agitation time) for the starch having a weight average molecular weight of 1,300,000 (G-800 produced by NIPPON STARCH CHEMICAL CO., LTD.) were changed.

5.1.2. Preparation of Starch Particle

Raw material starch 1 was crushed by using a fluidized-bed-type opposed jet mill (Counter Jet Mill AFG-R produced by Hosokawa Micron Corporation) at a treatment pressure of 4.0 bar so as to obtain starch particle 1-1 having an average particle diameter of 10 μm as a binding material particle C2. In addition, raw material starches 2 to 5 were subjected to the treatment akin to that applied to raw material starch 1 so as to obtain starch particles 2-1, 3-1, 4-1, and 5-1, respectively. Further, raw material starch 1 was subjected to the treatment akin to that applied when starch particle 1 was produced except that the treatment pressure during crushing was changed so as to obtain starch particle 1-2 having an average particle diameter of 2 μm (treatment pressure of 8.0 bar), starch particle 1-3 having an average particle diameter of 40 μm (treatment pressure of 1.5 bar), and starch particle 1-4 having an average particle diameter of 55 μm (treatment pressure of 1.0 bar).

5.1.3. Preparation of Binder

A Henschel mixer (FM Mixer FM 20C/I produced by NIPPON COKE & ENGINEERING CO., LTD.) was charged with 99 parts by mass of starch particle 1-1 serving as the binding material particle C2 and 1 part by mass of fumed silica (trade name: REOLOSIL (registered trademark), product No. DM-30S produced by Tokuyama Corporation) serving as the inorganic oxide particle C3, and mixing treatment was performed at a frequency of 60 Hz for 10 minutes. Thereafter, sifting treatment was performed by using a sieve with openings of 30 μm so as to prepare a binder C10 of example 1 including the composite particle C1 in which starch particle 1-1 serving as the binding material particle C2 and fumed silica serving as the inorganic oxide particle C3 were integrated.

Binders C10 of examples 2 to 16 and comparative example 1 were prepared in the manner akin to that in example 1 except that the binding material particle C2, the inorganic oxide particle C3, and the mixing ratio of the binding material particle C2 to the inorganic oxide particle C3 were set as presented in Table 1. In this regard, the inorganic oxide particles C3 in Table 1 are as described below.

- DM-30S: REOLOSIL, product No. DM-30S, Tokuyama Corporation, fumed silica
- HM-20L: REOLOSIL, product No. HM-20L, Tokuyama Corporation, fumed silica
- HM-30S: REOLOSIL, product No. HM-30S, Tokuyama Corporation, fumed silica
- ZD-30ST: REOLOSIL, product No. ZD-30ST, Tokuyama Corporation, fumed silica
- DM-30: REOLOSIL, product No. DM-30, Tokuyama Corporation, fumed silica
- NY-50: AEROSIL (registered trademark), product No. NY-50, NIPPON AEROSIL CO., LTD., fumed silica

TABLE 1

| | Binding material particle | | | | Inorganic oxide particle | | | |
|---|---|---|---|---|---|---|---|---|
| | Type | Weight average molecular weight | Average particle diameter [μm] | Content [% by mass] | Type | Amount of carbon [% by mass] | Average particle diameter [nm] | Content [% by mass] |
| Example 1 | starch particle 1-1 | 100,000 | 10.0 | 99.0 | DM-30S | 2.2 | 7.0 | 1.0 |
| Example 2 | starch particle 1-1 | 100,000 | 10.0 | 99.0 | HM-20L | 2.5 | 12.0 | 1.0 |
| Example 3 | starch particle 1-1 | 100,000 | 10.0 | 99.0 | HM-30S | 3.5 | 7.0 | 1.0 |
| Example 4 | starch particle 1-1 | 100,000 | 10.0 | 99.0 | ZD-30ST | 2.9 | 7.0 | 1.0 |
| Example 5 | starch particle 2-1 | 20,000 | 10.0 | 99.0 | HM-30S | 3.5 | 7.0 | 1.0 |
| Example 6 | starch particle 3-1 | 55,000 | 10.0 | 99.0 | HM-30S | 3.5 | 7.0 | 1.0 |
| Example 7 | starch particle 4-1 | 380,000 | 10.0 | 99.0 | HM-30S | 3.5 | 7.0 | 1.0 |
| Example 8 | starch particle 5-1 | 470,000 | 10.0 | 99.0 | HM-30S | 3.5 | 7.0 | 1.0 |
| Example 9 | starch particle 1-2 | 100,000 | 2.0 | 99.0 | HM-30S | 3.5 | 7.0 | 1.0 |
| Example 10 | starch particle 1-3 | 100,000 | 40.0 | 99.0 | HM-30S | 3.5 | 7.0 | 1.0 |
| Example 11 | starch particle 1-4 | 100,000 | 55.0 | 99.0 | HM-30S | 3.5 | 7.0 | 1.0 |
| Example 12 | starch particle 1-1 | 100,000 | 10.0 | 99.0 | NY-50 | 3.0 | 30.0 | 1.0 |
| Example 13 | starch particle 1-1 | 100,000 | 10.0 | 99.7 | HM-30S | 3.5 | 7.0 | 0.3 |
| Example 14 | starch particle 1-1 | 100,000 | 10.0 | 99.5 | HM-30S | 3.5 | 7.0 | 0.5 |
| Example 15 | starch particle 1-1 | 100,000 | 10.0 | 95.0 | HM-30S | 3.5 | 7.0 | 5.0 |
| Example 16 | starch particle 1-1 | 100,000 | 10.0 | 92.0 | HM-30S | 3.5 | 7.0 | 8.0 |
| Comparative example 1 | starch particle 1-1 | 100,000 | 10.0 | 99.0 | DM-30 | 1.7 | 7.0 | 1.0 |

5.1.4. Production of Sheet Serving as Formed Body

A sheet serving as the formed body was produced by using the binder of example 1.

A modified machine which was a modified sheet producing apparatus 100 (PaperLab (registered trademark) A-8000 produced by Seiko Epson Corporation) capable of humidifying a sheet after forming and before application of pressure was prepared. A sheet-like material M1 of commercially available copy paper (GR70-W produced by Fuji Xerox Co., Ltd.) printed with business document content by using an ink jet printer was used as a fiber source.

Subsequently, the sheet-like material M1 above was supplied to the raw material supply portion 11 of the sheet producing apparatus 100, and the binder C10 produced in "Preparation of binder" above was supplied to the binder supply portion 171. The sheet producing apparatus 100 was operated so as to produce an A4-sized sheet S serving as a formed body by applying treatments of a coarse crushing step, a defibration step, a sorting step, a first web forming step, a subdivision step, a mixing step, a disentanglement step, a second web forming step serving as an accumulating step, a humidifying step, a sheet forming step serving as a forming step, and a cutting step. The basis weight of the resulting sheet S was 90 g/m$^2$.

At this time, the raw material of the sheet S which was a finally obtained formed body was adjusted to contain 10 parts by mass of binder C10 relative to 90 parts by mass of the fiber.

A4-sized sheets S serving as formed bodies were produced in the manner akin to that in Example 1 except that the respective binders of Examples 2 to 16 and Comparative example 1 were used as the binder C10.

5.2. Evaluation 5.2.1. Fluidity of Binder

Regarding the binders of Examples 1 to 16 and Comparative example 1, the repose angle and the compression degree were measured by using a powder characteristics tester (Powder Tester (registered trademark) PT-X, produced by Hosokawa Micron Corporation). The fluidity value which is a product of the repose angle)(° and the compression degree (%) was determined from the measurement result and evaluated in accordance with the following criteria. In this regard, it can be said that a smaller fluidity value corresponds to more excellent fluidity.

A: the fluidity value is less than 10

B: the fluidity value is 10 or more and less than 12

C: the fluidity value is 12 or more and less than 14

D: the fluidity value is 14 or more and less than 17

E: the fluidity value is 17 or more

The results are presented in Table 2.

5.2.2. Strength of Formed Body

Strips of 100 mm×20 mm were cut from the sheets S serving as the formed bodies produced in Examples 1 to 16 and Comparative example 1, and the breaking strength in the longitudinal direction of the strip was measured. An Autograph AGS-1N produced by SHIMADZU CORPORATION was used for measuring the breaking strength, and the breaking strength was measured at a pulling rate of 20 mm/sec. The specific tensile strength was calculated therefrom and evaluated in accordance with the following criteria. In this regard, it can be said that a larger specific tensile strength corresponds to more excellent strength.

A: the specific tensile strength is 25 Nm/g or more

B: the specific tensile strength is 20 Nm/g or more and less than 25 Nm/g

C: the specific tensile strength is 15 Nm/g or more and less than 20 Nm/g

D: the specific tensile strength is 10 Nm/g or more and less than 15 Nm/g

E: the specific tensile strength is less than 10 Nm/g

The results are presented in Table 2.

TABLE 2

| | Powder fluidity | Breaking strength |
|---|---|---|
| Example 1 | C | C |
| Example 2 | B | B |
| Example 3 | A | A |
| Example 4 | A | A |
| Example 5 | A | B |
| Example 6 | A | A |
| Example 7 | A | A |
| Example 8 | A | B |
| Example 9 | C | A |

TABLE 2-continued

| | Powder fluidity | Breaking strength |
|---|---|---|
| Example 10 | A | A |
| Example 11 | A | C |
| Example 12 | C | C |
| Example 13 | C | C |
| Example 14 | B | B |
| Example 15 | B | B |
| Example 16 | A | C |
| Comparative example 1 | D | D |

As is clear from Table 2, regarding the strength test of the formed body, Examples 1 to 16 were rated as C or better, and excellent results were obtained. On the other hand, regarding Comparative example 1, the strength of the formed body was rated as D, and a satisfactory result was not obtained. In addition, regarding the powder fluidity test, the binders of Examples 1 to 16 were rated as C or better, whereas the binder of Comparative example 1 was rated as D. Therefore, the results of the strength test of the formed body were supported.

What is claimed is:

1. A formed body producing method comprising:

an accumulating step of accumulating a mixture including cellulose fibers and a binder, the binder including starch particle configured to mutually bind the cellulose fibers when water is provided, and inorganic oxide particles, wherein the binder includes a composite particle in which the starch particle and the inorganic oxide particles are integrated such that the inorganic oxide particles are attached to the surface of the starch particle before the accumulating step, the inorganic oxide particles contain carbon, and the content of the carbon is 2% by mass or more relative to the mass of the inorganic oxide particles;

a humidifying step of providing the accumulated mixture with water to facilitate a hydrogen bond between the cellulose fibers and the starch particle of the binder; and a forming step of obtaining a formed body by heating and applying pressure to the mixture provided with water.

* * * * *